US012330007B2

(12) United States Patent
Kim

(10) Patent No.: US 12,330,007 B2
(45) Date of Patent: Jun. 17, 2025

(54) EXERCISE METHOD AND DEVICE FOR ADJUSTING AN ELASTIC RESISTANCE STRENGTH OF AN ELASTIC BODY THAT IS USED IN EXERCISE OR REHABILITATION

(71) Applicant: Eun Bee Kim, Chuncheonsi (KR)

(72) Inventor: Eun Bee Kim, Chuncheonsi (KR)

( * ) Notice: Subject to any disclaimer, the term of this patent is extended or adjusted under 35 U.S.C. 154(b) by 172 days.

(21) Appl. No.: 17/958,416

(22) Filed: Oct. 2, 2022

(65) Prior Publication Data

US 2024/0024722 A1 Jan. 25, 2024

(30) Foreign Application Priority Data

| | | |
|---|---|---|
| Jul. 24, 2022 | (KR) | 10-2022-0091435 |
| Aug. 4, 2022 | (KR) | 10-2022-0097046 |
| Aug. 21, 2022 | (KR) | 10-2022-0104453 |
| Oct. 2, 2022 | (KR) | 10-2022-0125912 |

(51) Int. Cl.
*A63B 21/00* (2006.01)
*A63B 21/055* (2006.01)

(52) U.S. Cl.
CPC .... *A63B 21/00069* (2013.01); *A63B 21/0557* (2013.01); *A63B 2225/09* (2013.01)

(58) Field of Classification Search
CPC ..... A63B 21/00069; A63B 21/0557; A63B 2225/09; A63B 21/065; A63B 21/4011; A63B 21/4039; A63B 21/0552; A63B 21/4017; A63B 21/4009; A63B 71/023; A63B 69/0057; A63B 21/16; A63B 21/00061; A63B 2023/003; A63B 23/047; A63B 23/03541; A63B 23/03525; A63B 21/00065; A63B 21/0724; A63B 21/068; A63B 2022/0094; A63B 21/4034; A63B 21/4035; A63B 23/0233; A63B 2210/50;
(Continued)

(56) References Cited

U.S. PATENT DOCUMENTS

| | | | | |
|---|---|---|---|---|
| 728,206 A * | 5/1903 | Crafts | A44B 11/28 24/196 |
| 2,704,871 A * | 3/1955 | Bender | A44B 11/223 24/710.3 |

(Continued)

*Primary Examiner* — Garrett K Atkinson
(74) *Attorney, Agent, or Firm* — Eun Bee Kim

(57) ABSTRACT

A method and device for adjusting an elastic strength of an elastic body that is used in exercise or rehabilitation comprising a first elastic body provided in shape having one end and the other end; a second elastic body provided to be separated from the first elastic body; a first length adjusting device wherein a part of the first elastic body and a part of the second elastic body is provided to overlap each other in a manner that some parts of the first elastic body and the second elastic body pass through the first length adjusting device and fixed; and a second length adjusting device provided to be put on in parallel with the first length adjusting device in the lengthwise direction of the elastic bodies; so that as a result, when a user carries out muscle resistance exercise by using the first elastic body, the ends of the second elastic body move in the air and do not interfere with a resistive force but the overlapped portion of the second elastic body adds a resistive force to the first elastic body, such that the elastic strength of the elastic body is conveniently adjusted.

1 Claim, 9 Drawing Sheets

A

B

(58) Field of Classification Search
CPC ..... A63B 2209/10; A63B 2071/025; A63B 2225/093
See application file for complete search history.

(56) References Cited

U.S. PATENT DOCUMENTS 3,069,169 A * 12/1962 Topping ..... A63B 69/0059 473/212
3,819,177 A * 6/1974 Spiro ..... A63B 21/00043 482/122
3,963,157 A * 6/1976 Truax ..... A63B 47/001 224/663
4,506,883 A * 3/1985 Rathbun ..... A63B 23/03575 482/13
4,570,929 A * 2/1986 Shoemaker ..... A63B 21/0552 112/475.08
4,815,731 A * 3/1989 Suarez ..... A63B 21/055 482/126
4,862,563 A * 9/1989 Flynn ..... F16B 2/08 24/442
5,295,949 A * 3/1994 Hathaway ..... A63B 23/025 602/14
D353,172 S * 12/1994 Gaut ..... D30/152
5,718,640 A * 2/1998 Noblin ..... A63B 69/0059 473/409
5,951,443 A * 9/1999 Askins ..... A63B 23/047 482/148
6,027,413 A * 2/2000 Smith ..... A63B 21/0552 473/215
6,036,068 A * 3/2000 Cartmell ..... A45F 5/00 224/660
6,196,931 B1 * 3/2001 Wilt ..... A63B 69/3608 473/212
6,248,043 B1 * 6/2001 Morton ..... A63B 21/0004 482/124
6,502,862 B1 * 1/2003 Lenhart ..... A45B 9/02 280/821
6,755,755 B2 * 6/2004 Wah Loh ..... A63B 21/4009 119/770
7,789,248 B1 * 9/2010 Salerno ..... A63B 71/0036 211/106.01
10,029,136 B2 * 7/2018 Aldridge ..... A63B 21/00185
10,517,339 B1 * 12/2019 Baxter ..... A41D 20/00
10,737,136 B2 * 8/2020 Burkinshaw ..... A63B 21/1636
D949,667 S * 4/2022 Martinez ..... D8/356
2003/0037367 A1 * 2/2003 Fukasawa ..... A63B 33/004 2/428
2016/0236026 A1 * 8/2016 Hauptmann ..... A63B 21/00069
2016/0317853 A1 * 11/2016 Benocci ..... A63B 21/4009
2020/0376342 A1 * 12/2020 Mumford ..... A63B 29/02
2023/0321479 A1 * 10/2023 Yu ..... A63B 21/00185 482/124

* cited by examiner

EXERCISE METHOD AND DEVICE FOR ADJUSTING AN ELASTIC RESISTANCE STRENGTH OF AN ELASTIC BODY THAT IS USED IN EXERCISE OR REHABILITATION

This application claim foreign priority of KR 10-2022-0097046 filed on 2022 Aug. 4; KR10-2022-0125912 filed 2022 Oct. 2.

TECHNICAL FIELD

The present invention relates to a method and device for adjusting an elastic resistance strength of an elastic body that is used in exercise or rehabilitation.

BACKGROUND

The overload principle is one of the seven big laws of fitness and training. It says that you have to increase the intensity of a workout progressively to see adaptations. The adaptations are improvements in muscle size.

Accordingly, magnetic resistance devices, wire block boxes, or spring devices are popularly used as resistance strength auxiliary devices of exercise equipment. In addition, an elastic belt or rubber tube made of rubber or silicone is used as an exercise device by itself.

A device called an elastic body, such as a spring, a rubber tube, or an elastic belt, is provided to gradually increase the elastic resistance strength by classifying the elastic modulus or the length of the elastic body. An elastic body called a "Elastic Belt," made of only latex material, was recently made by mixing a material such as cotton and natural rubber to reduce the pressure applied to the user's body. Rubber is applied to one surface in the longitudinal direction of the elastic belt so that it does not come down in close contact with the user's body. In addition, a length adjusting device is provided to classify the resistance strength according to the length of the belt. The length adjusting device has a tooth-shaped protrusion in the inner hole of the length adjusting device to be fixed without sliding during use.

However, the resistance strength adjustment according to the length of the belt has a limitation in that it can be adjusted only within the range suitable for an exercise movement. For example, it cannot be adjusted to be shorter or longer than suitable for an exercise movement.

Also, when the strength is adjusted according to the number of windings around the body (KR 20-2020-0001795), the difference between the strength of one winding and the strength of two windings is too significant. For example, when winding once is too easy, winding twice is too hard that it is difficult to easily adjust the strength in steps such as 1+⅛, 1+⅜, 1+⅜, etc.

In addition, when the strength is adjusted according to the material's elastic modulus, there is a disadvantage in that several purchases are required.

The elastic body also has a disadvantage because it deforms when it exceeds a specific stress limit. However, it has advantages such as cost reduction and easy transport compared to magnetic resistance, block boxes, discs, etc.

SUMMARY

Accordingly, the object of the present invention is to provide an elastic resistance strength adjusting device that can be conveniently adjusted in several steps without purchasing a new one whenever the exercise ability is upgraded by subdividing the elastic resistance strength in one product.

Lastly, the conventional elastic body has the characteristic that the resistance strength is not uniformly applied in the entire range of motion, and the resistance strength is low in the starting section of the motion range where the force is used. The resistance strength is high in the last section. Referring to FIG. 13, it can be seen that when the user pulls the elastic body in the direction of the arrow, the strength required to move to point b' is much greater than the strength needed to move to point a'. Therefore, the actual resistance strength is not balanced in the entire range of motion but is made high in the last section and weak in the first section.

The present invention, to achieve the object in the prior art as described above, comprises a first elastic body provided in shape having one end and the other end; and a second elastic body provided to be separated from the first elastic body, wherein a part of the first elastic body and a part of the second elastic body are provided to overlap each other in the manner that a first length adjusting deviceG which is provided so that some parts of the first elastic body and the second elastic body are passed therethrough and fixed and a second length adjusting deviceH which is provided to be put on in parallel with the first length adjusting device in the lengthwise direction of the elastic bodies, a size of the portion, in which one part and another part of the elastic bodies overlap each other, in the lengthwise direction of the elastic bodies is set to be adjusted within an interval between a position of the first length adjusting deviceG and a position of the second length adjusting deviceH, and when a user carries out muscle resistance exercise by using opposite ends of the first elastic body, opposite end of the second elastic body move in the air and do not interfere with a resistive force, and the second elastic body adds the resistive force to the first elastic body by using the first length adjusting device and the second length adjusting device such that an elastic strength of the elastic bodies is conveniently adjusted.

In addition, by adding additional length adjustment members I and J and an additional elastic body to the elastic body, the strength can be upgraded by subdividing the strength into several stages by adjusting the distance between I and J as if adjusting the distance between G and H can.

According to the present disclosure, an interval between two or more length adjusting devices is adjusted, wherein the length adjusting devices are fixedly put onto elastic bodies so that one part and another part of the elastic bodies overlap each other, and thus, a length of an overlapping portion of the elastic bodies is decreased or increased without changing a total length of the elastic bodies. Accordingly, a resistance strength may be minutely adjusted.

In detail, when an area (length) of the portions of the elastic bodies that overlap each other and are fixed is adjusted by the two or more length adjusting devices that are provided with an inner hole so that a part and another part of the elastic bodies pass therethrough while overlapping each other, the length of the elastic bodies does not change. Still, the thickness of the part where the elastic bodies are fixed while overlapping each other by the length adjusting devices is increased, and the total resistance strength of the elastic bodies increases. Therefore, the resistance strength may be minutely adjusted without changing the length of the elastic bodies and without adding a new elastic body.

In addition, when it is assumed that a resistance strength of an elastic belt according to the related art is divided into six steps, that is, da, db, dc, ea, eb, and ec, in a combination of resistance strength steps a, b, and c according to the length and resistance strength steps d, e, and f according to an elastic stress of a material, according to the present disclosure, in addition to the resistance strength steps a, b, and c according to the length and the resistance strength steps d, e, and f according to the elastic stress, the steps of the resistance strength may be upgraded and subdivided into, for example, da+⅛d, da+⅜d, da+⅜d . . . db+⅛d, db+⅜d, db+⅜d . . . dc+⅛d, dc+⅜d, dc+⅜d . . . ea+⅛e, ea+⅜e, ea⅜e . . . eb+⅛e, eb+⅜e, eb+⅜e . . . ec+⅛e, ec+⅜e, ec+⅜e . . . fa+⅛f, fa+⅜f, fa+⅜f.fb+⅛f, fb+⅜f, fb+⅜f . . . fc+⅛f, fc+⅜f, fc+⅜f, etc.

In other words, a portion, in which a part and another part of the elastic bodies are fixed while overlapping each other in the lengthwise direction of the elastic body is set to be adjusted within an interval between a position of a first length adjusting device and position of a second length adjusting device. Thus, the elastic force of the elastic bodies may be adjusted by adjusting the interval between the position of the first length adjusting device and the second length adjuster.

DETAILED DESCRIPTION OF THE ILLUSTRATIVE EMBODIMENTS

Figure 1:
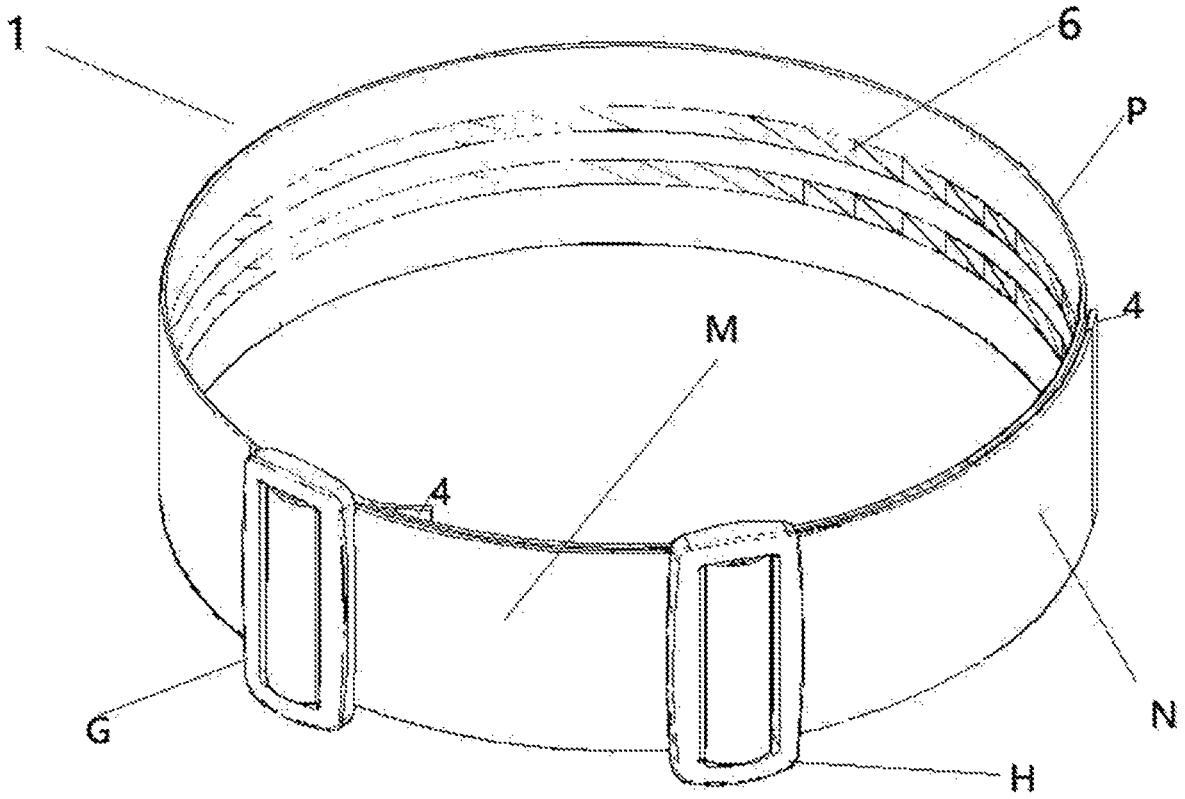
FIG. 1 is a perspective view showing an embodiment of the present invention.

Embodiment of the device and method to adjust the elastic strength will now be described in detail regarding the drawings. As shown in FIGS. 4, 6 to 8, an embodiment of the present invention provides a first elastic body provided in shape having one end and the other end; and a second elastic body provided to be separated from the first elastic body. A part of the first elastic body and a part of the second elastic body is provided to overlap each other in a manner that some parts of the first elastic body and the second elastic body pass through the first length adjusting device G and fixed. And a second length adjusting device H is provided to be put on in parallel with the first length adjusting device in the lengthwise direction of the elastic bodies. So that a size of the portion in which the first and the second elastic bodies overlap each other, in the lengthwise direction of the elastic bodies, is set to be adjusted within an interval between a position of the first length adjusting device G and a position of the second length adjusting device H. As a result, when a user carries out muscle resistance exercise by using the first elastic body, the ends of the second elastic body move in the air and do not interfere with a resistive force. However, the second elastic body adds a resistive force to the first elastic body by using the first adjusting device and the second adjusting device, such that the elastic strength of the elastic body is conveniently adjusted.

Referring to FIGS. 1, 5, 9, 10, 11, an embodiment of the device and method to adjust the elastic strength provides an elastic belt(1,2,3) preferably made of a mixed knitted fabric of fibers such as cotton and rubber filaments. The elastic belt is preferably provided as a belt winded in spiraling turns, having one end 4 and the other 4. The elastic belt is provided to overlap each other in a winding in spiraling turns manner that inner parts of the elastic belt and outer part of the elastic belt pass through a first length adjusting device G and fixed. And a second length adjusting device H is provided to be put on in parallel with the first length adjusting device in the lengthwise direction of the elastic bodies. So that a size of the portion in which the first and the second elastic bodies overlap each other, in the lengthwise direction of the elastic bodies, is set to be adjusted within an interval between a position of the first length adjusting device G and a position of the second length adjusting device H. Preferably a rubber member 6 is configured on a surface of the elastic belt in the longitudinal direction to provide a frictional force so that the portion where the belt overlaps within the length adjusting device does not slip. When a user carries out muscle resistance exercise by using an inner winding portion of the elastic belt, an outer winding portion of the elastic belt moves in the air. Therefore, it does not interfere with a resistive force. On the other hand, the overlapped portion of the outer winding portion of the elastic belt adds a resistive force to the inner winding portion. Such that the elastic strength of the elastic belt is conveniently adjusted by adjusting the position of the length adjusting device.

Figure 2:
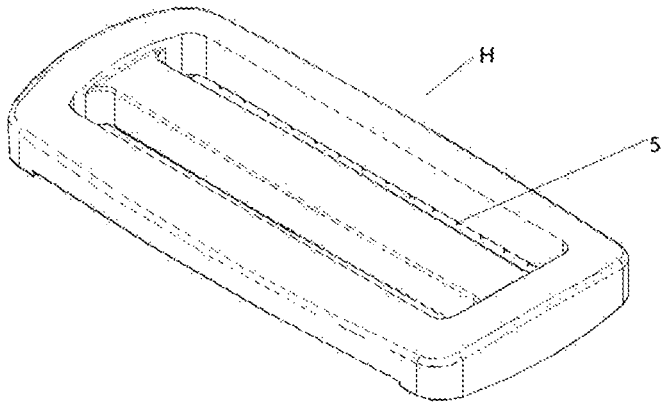
FIG. 2 is a partial view of an embodiment of the present invention showing a length-adjusting device.
Figure 3:
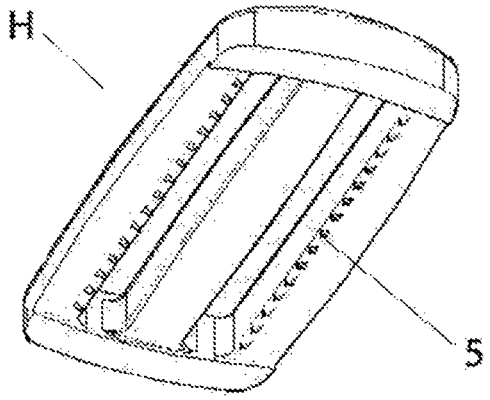
FIG. 3 is a partial view of an embodiment of the present invention illustrating a length-adjusting device.

In addition, as shown in FIGS. 2, 3, a large number of teeth-shaped protrusion 5 is preferably provided within an inner hole of the length adjusting device so that a part and another part of the elastic bodies pass through the length adjusting device and fix without sliding during use. The length adjusting device is provided in two or more. From now on, the length adjustment will be named G, H, I, and J. The elastic force of the elastic body will be adjusted by adjusting a length of an overlapping portion of the elastic body. Thus, an elastic force of the elastic body is adjusted by an interval M between the position of the length adjustment G and the position of the length adjustment H.

Figure 4:
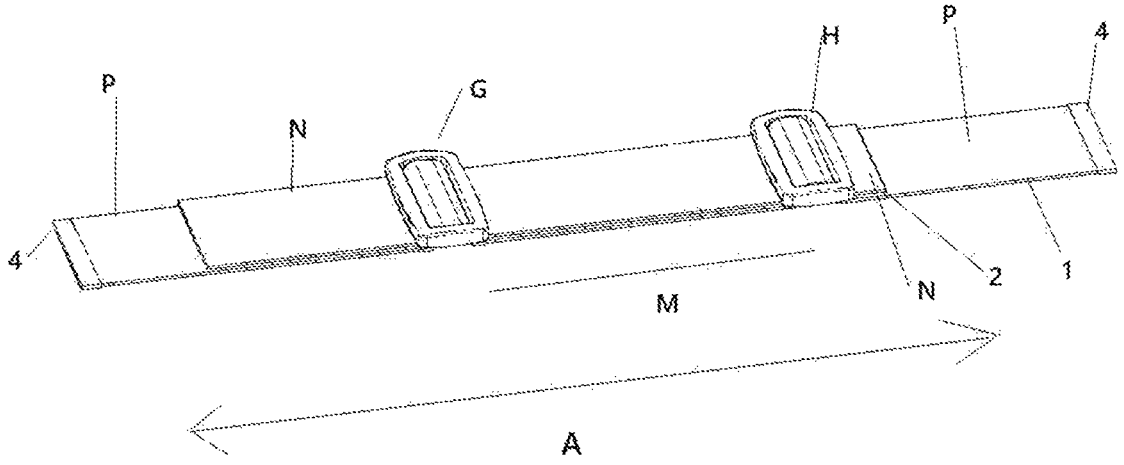
FIG. 4 is a view illustrating a device and method for adjusting an elastic resistance strength of an elastic body according to an embodiment of the present invention.
Figure 4:
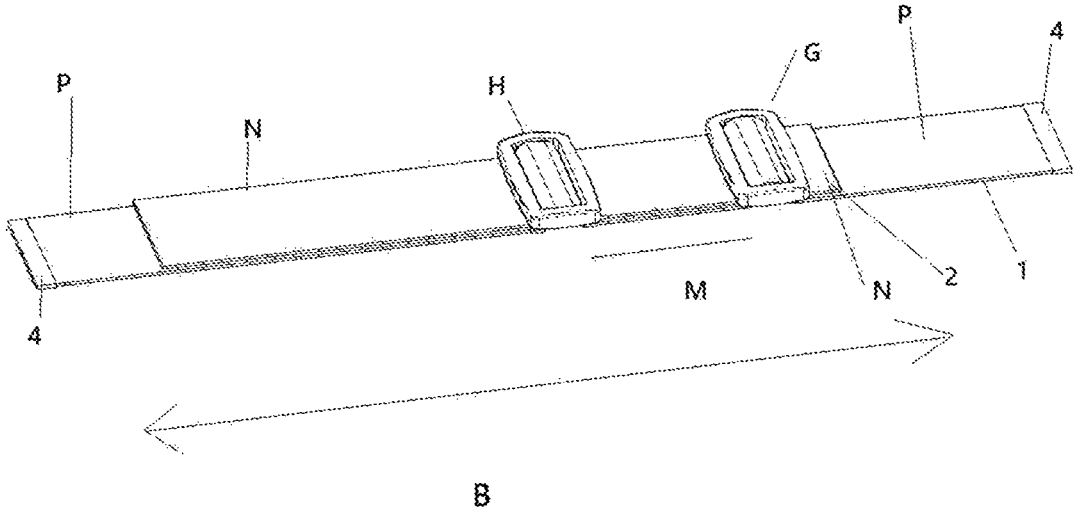
Figure 5:
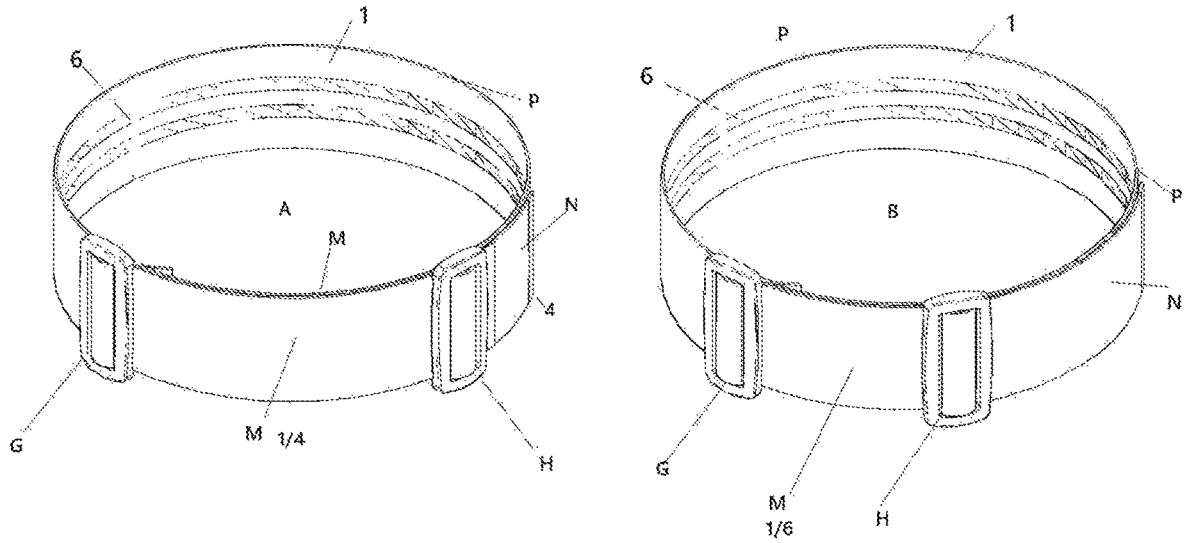
FIG. 5 is a view illustrating a device and method for adjusting an elastic resistance strength of an elastic body according to an embodiment of the present invention.
Figure 6:
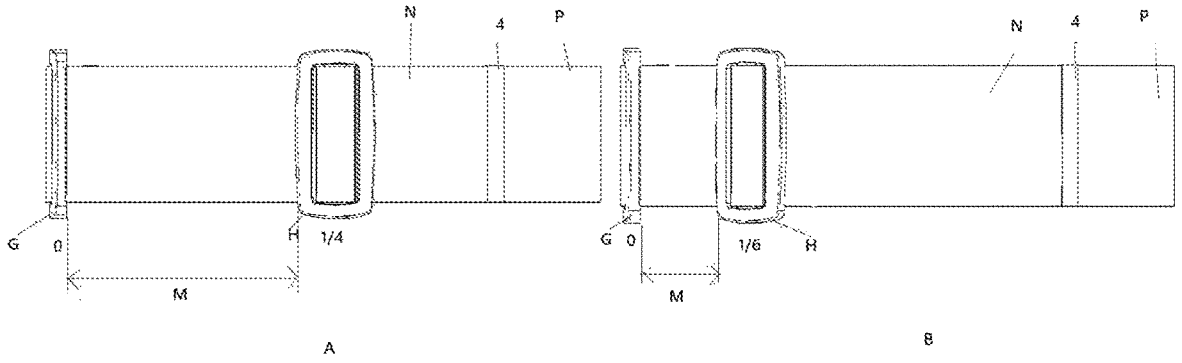
FIG. 6 is a view illustrating a device and method for adjusting an elastic resistance strength of an elastic body according to an embodiment of the present invention.

Referring to FIGS. 4 to 6, an embodiment of the device and method to adjust the elastic strength will be described. An elastic force of the elastic body is minutely adjusted by adjusting an interval M between the position of the length adjusting device G and the position of the length adjusting device H.

Specifically, as shown in FIG. 4, the first elastic body provides a first elasticity P. The first elastic body can be coupled to an additional second elastic body 2 by length adjusting devices G and H. The part of the second elastic body that combines to provide additional elasticity is between the length adjusting device G and H. Between the length adjusting device G and H is shown as M. The other part N moves in the air and does not provide additional elasticity.

Referring to FIGS. 4, 5, and 6, the actual length of elastic bodies in Figures A and B is the same. However, an interval between the position of the length adjustment G and the position of the length adjustment H, which is shown as M is longer in Figure A than in Figure B. Therefore, the elastic resistance strength of the elastic body is higher in Figure A than in Figure B. In this way, the resistance strength of the elastic body can be minutely adjusted by adjusting the position of G and H.

Figure 7:
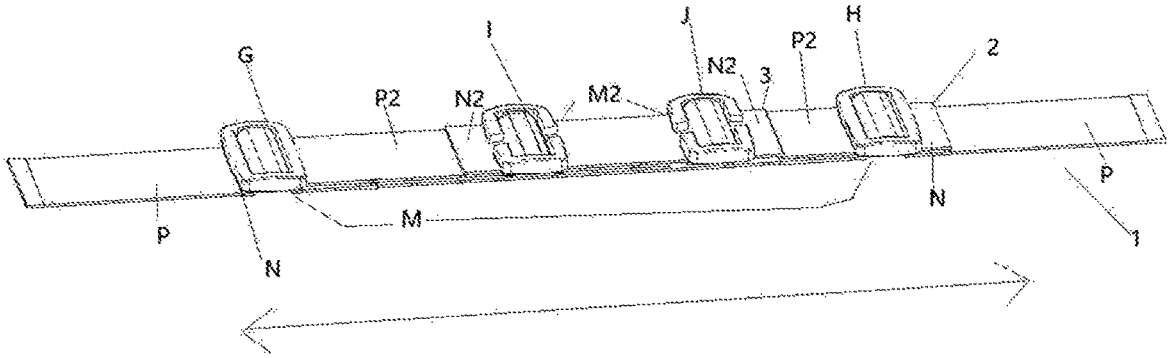
FIG. 7 is a view illustrating a device and method for adjusting an elastic resistance strength of an elastic body according to an embodiment of the present invention.
Figure 8:
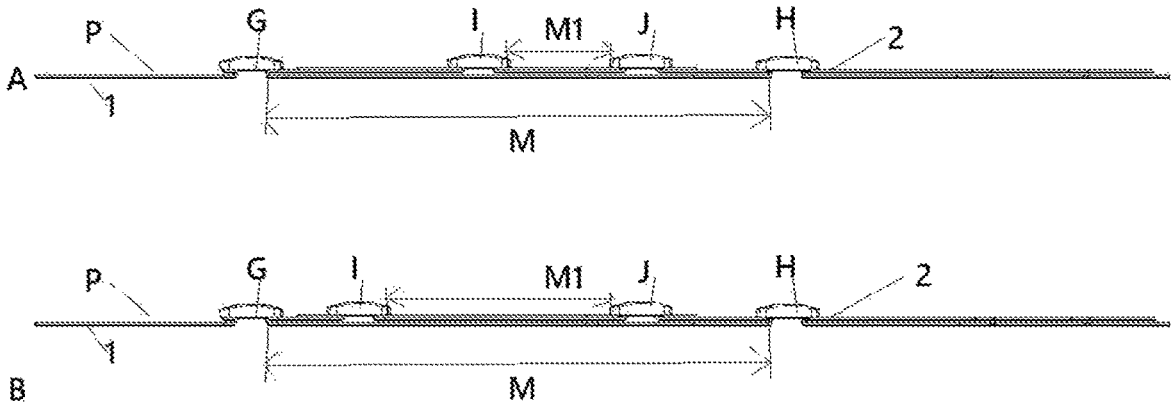
FIG. 8 is a view illustrating a device and method for adjusting an elastic resistance strength of an elastic body according to an embodiment of the present invention wherein three separate elastic bodies and four length adjusters are provided.

Referring to FIGS. 4, 7, and 8, an embodiment of the device and method to adjust the elastic comprises the elastic belt configured in a straight line figure, as shown in FIGS. 4, 7, and 8. The user may hold both ends of a first elastic body while using. An attachment such as a ring can be provided at both ends of the first elastic body 1. It can be used as an auxiliary resistance device by fixing it to a resistance exercise machine. Referring to FIGS. 1, 5, 6, 9, 10, an embodiment of the device and method to adjust the elastic strength comprises an elastic body configured in a spiral line figure to wrap the user's body. It comprises the length adjusting device G to adjust the length of the elastic body. The elastic body can be used to wrap the user's thighs and to create resistance to spreading both legs for the purpose of strengthening the hip muscles. The length-adjusting devices G and H are used as resistance adjusters to adjust the length of an overlapping fixed portion of the elastic band.

In addition, as shown in FIGS. 7, 8, 9, and 10, additional elastic body 2 and 3 and additional length adjustment I and J, may also be provided for additional resistance strength.

As shown in FIG. 7, additional length adjusting device I, J can be used to connect a third elastic body to the first elastic body 1. It can add proportional resistance. As N1 does not provide resistance during exercise, N2 does not provide resistance during use.

As shown in FIG. 8, the resistance may be added with additional elastic body and length adjustments. For example, in FIG. 8, the resistance strength of elastic body higher in Figure B than in Figure A.

Figure 9:
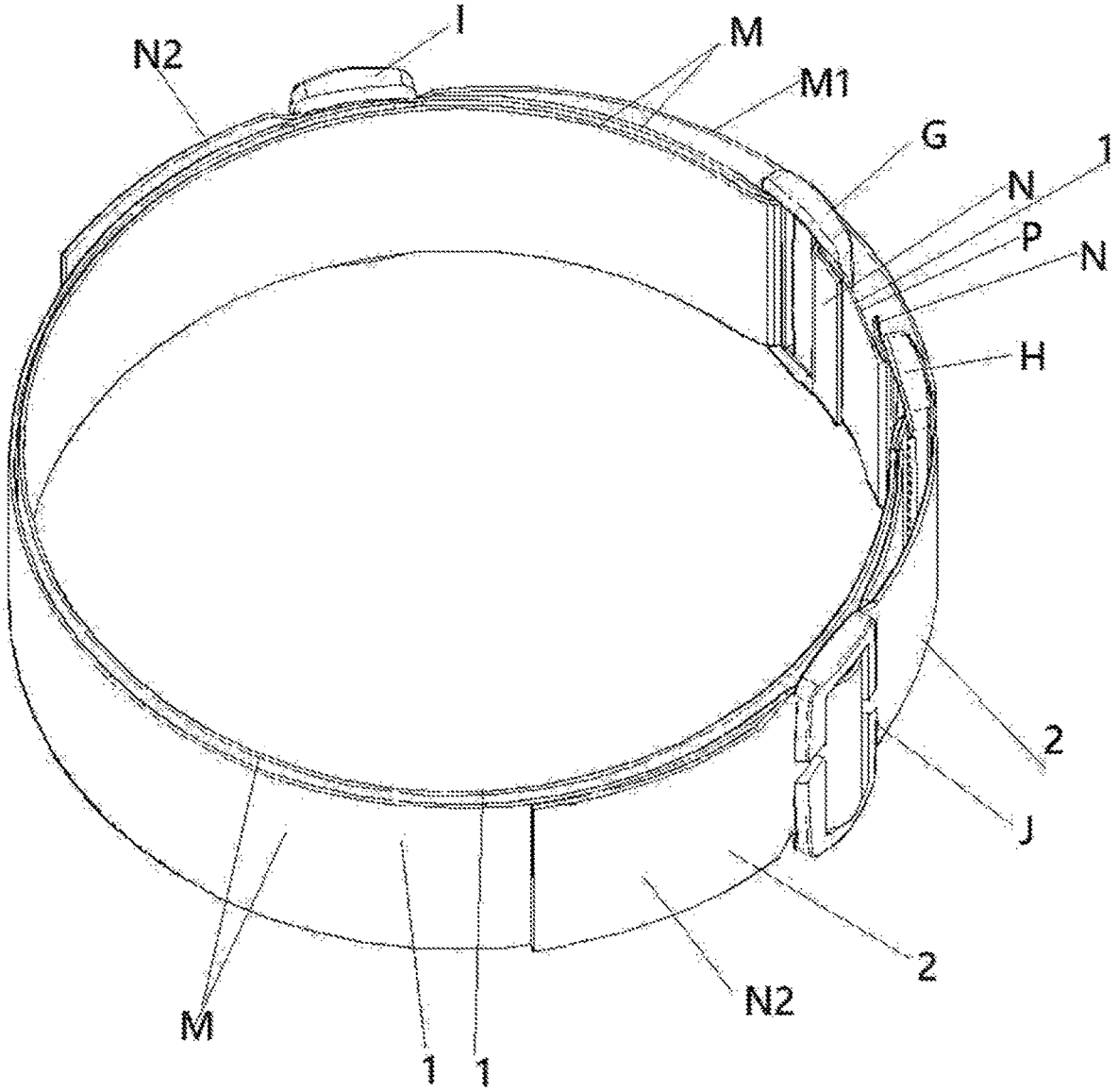
FIG. 9 is a view illustrating a device and method for adjusting an elastic resistance strength of an elastic body according to an embodiment of the present invention wherein two separate elastic bodies and four length adjusters are provided.
Figure 10:
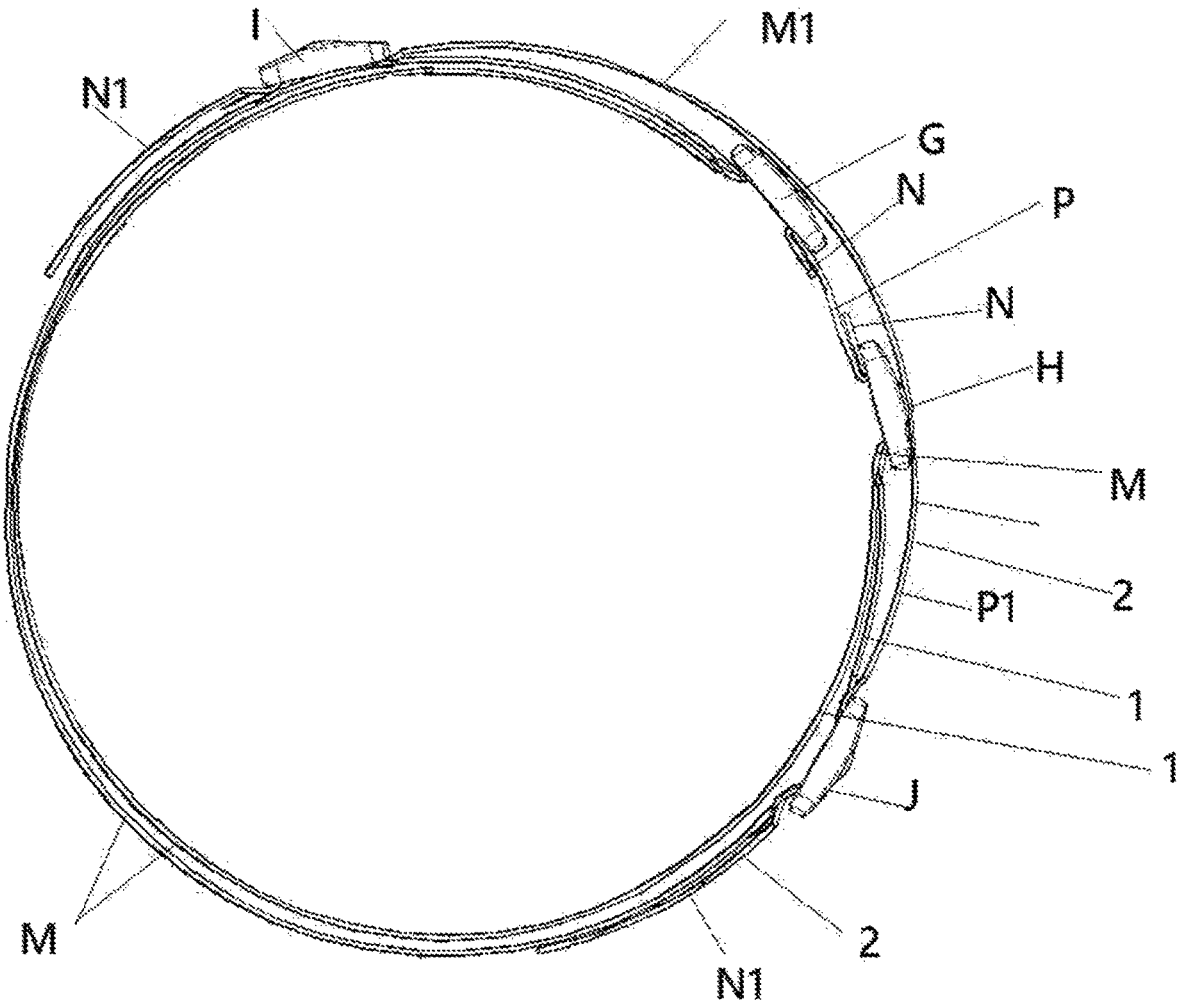
FIG. 10 is a view illustrating a device and method for adjusting an elastic resistance strength of an elastic body according to an embodiment of the present invention wherein two separate elastic bodies and four length adjusters are provided.

As shown in FIGS. 9 to 10, the resistance may be added with additional elastic body and length adjustments wherein the elastic body is in a circular and spiral form.

Figure 11:
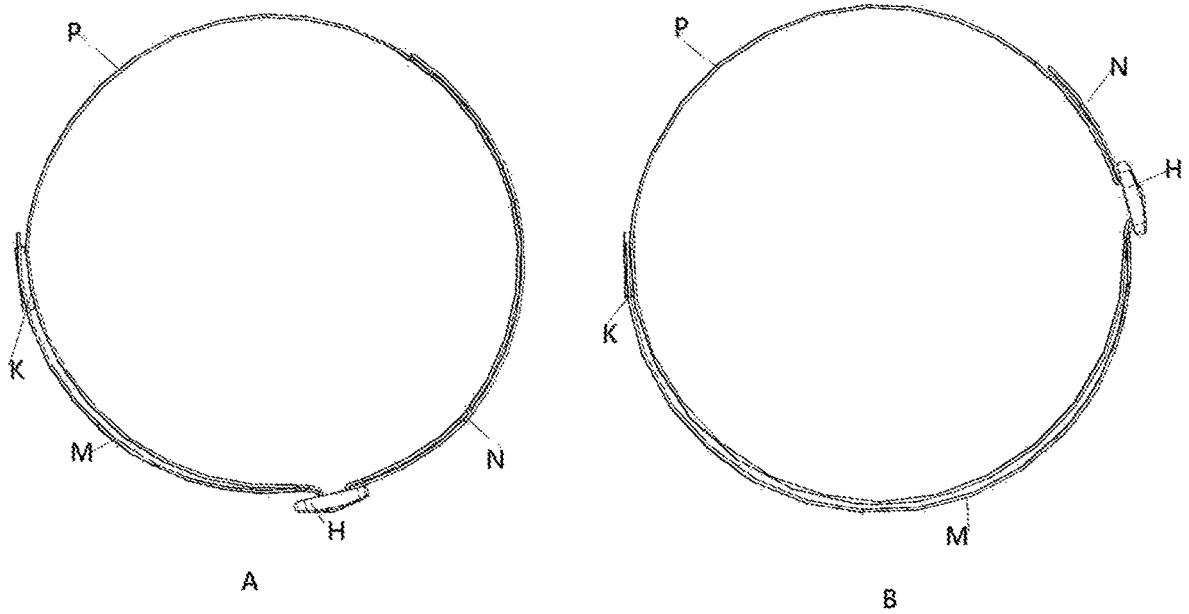
FIG. 11 is a view illustrating a device and method for adjusting an elastic resistance strength of an elastic body according to an embodiment of the present invention wherein a part of an elastic body and a part of another elastic body are connected, and one length adjusting device is provided.
Figure 12:
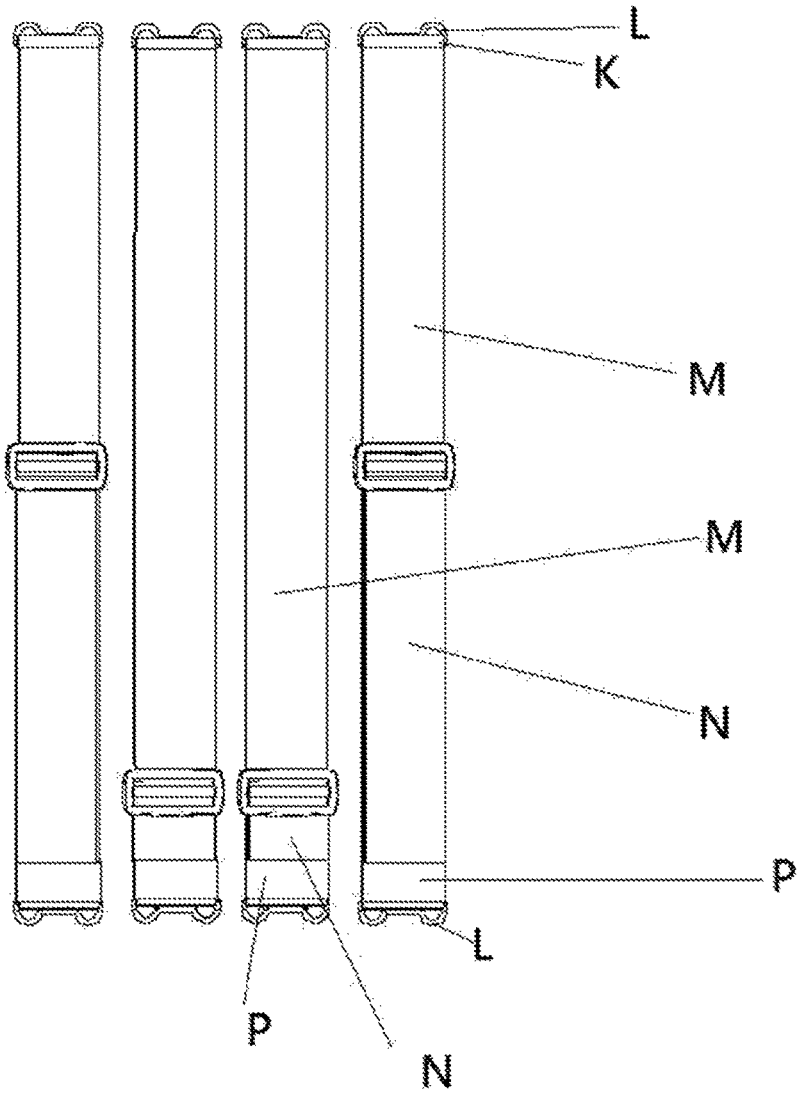
FIG. 12 is a view illustrating a device and method for adjusting an elastic resistance strength of an elastic body according to an embodiment of the present invention wherein a part of an elastic body and a part of another elastic body is connected.

In addition, as shown in FIGS. 11 to 12, an embodiment of the device and method to adjust the elastic provides an elastic body in a shape having one end and the other end; wherein one part and another part of the elastic body overlap each other; and the length of the overlapping area in the lengthwise direction of the elastic bodies are fixed by a length adjusting device that the part and another part of the elastic bodies pass through the length adjusting device for overlapping each other. The thickness of the elastic body increases where elastic bodies are fixed together M by the length-adjusting device H, and it decreases where the elastic bodies are not overlapped N by the length-adjusting device H. So that the resistance strength of the elastic body is set to be adjusted within an interval between the position of the length-adjusting device H and a connected portion of the first and second elastic bodies K.

Referring to FIG. 11, A device and method for adjusting an elastic strength of an elastic body that is used in exercise or rehabilitation comprises: an elastic body provided as a body winded in spiraling turns, having one end and the other end of the elastic body provided to overlap each other in a winding in spiraling turns manner; wherein a inner winding portion of the elastic body (the first winding part) and an outer winding portion of the elastic body (the second winding part) are connected and fixed; a length adjusting device provided to be put on in parallel with the connected portion of the elastic body in a lengthwise direction of the elastic bodies so that a size of the portion in which the elastic bodies overlap each other, in the lengthwise direction of the elastic bodies, is set to be adjusted within an interval between a position of the length adjusting device and a position of the connected portion of the elastic body; wherein when a user carries out muscle resistance exercise by using an inner winding portion of the elastic body (the first winding part), an outer winding portion of the elastic body (the second winding part) moves in the air that the outer part of the elastic body b does not interfere with a resistive force but the overlapped portion of the outer winding portion of the elastic body adds a resistive force to the inner winding portion such that the elastic strength of the elastic body is conveniently adjusted by adjusting the position of the length adjusting device; wherein a thickness of the elastic body increases where elastic bodies are fixed together by the length adjusting device and it decreases where the elastic bodies are not overlapped by the length adjusting device so that the resistance strength of the elastic body is set to be adjusted within an interval between the position of the length adjusting devices. As shown in FIG. 12, a device and method for adjusting an elastic strength of an elastic body that is used in exercise or rehabilitation comprises a first elastic body provided in shape having one end and the other end; a second elastic body wherein a part of the first elastic body and a part of the second elastic body is provided to overlap each other; and a part of the first elastic body and an end of the second elastic body are connected in a length wise direction of the elastic bodies K; a length adjusting device provided to overlap some parts of the first elastic body and some parts of the second elastic body in a manner that some parts of the first elastic body and the second elastic body pass through the length adjusting device and fixed; wherein the length adjusting device is provided to be put on in parallel with the connected portion of the elastic bodies in the lengthwise direction; so that a size of the portion in which the elastic bodies overlap each other in the lengthwise direction of the elastic bodies is set to be adjusted within an interval between a position of the length adjusting device and a position of the connected portion of the elastic bodies K; and as a result, when a user carries out muscle resistance exercise by using the first elastic body, the ends of the second elastic body move in the air and do not interfere with a resistive force but the overlapped portion of the second elastic body adds a resistive force to the first elastic body, such that the elastic strength of the elastic body is conveniently adjusted.

Figure 13:
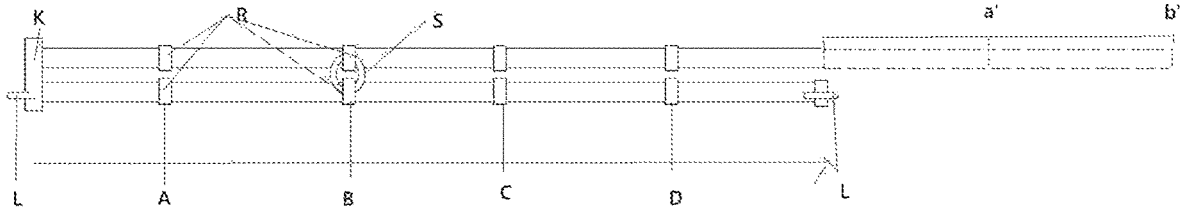
FIG. 13 is a view illustrating an embodiment of the present invention wherein two or more rings are provided as length adjusting devices.

It is also a part of the technical idea according to the present invention that the length adjusting device is provided in the form of "H" shown as I in FIGS. 7 to 9. In addition, as shown in FIG. 12, an embodiment of the invention may provide a number of elastic bodies. An embodiment of the present invention may provide a ring to be used as the length adjusting device to control the resistance of the elastic body. As shown in FIG. 13, the elastic body can be provided in the form of a tube.

Additionally, as shown in FIG. 13, the elastic body can be provided in the form of a rope. The length adjusting device can be provided in the form of a ring, and a plurality of rings or holes can be provided at regular intervals in the longitudinal direction of the elastic body. An apparatus for adjusting the strength of the elastic body by fastening the ring or hook to a ring or hole provided at a position suitable for the user's desired strength and a method of using the same are also part of the technical idea according to the present invention.

EXPLANATION OF SYMBOLS

1: first elastic body
2: Second elastic body
4: An end of an elastic body
5: tooth
6: rubber member
G: first length adjusting device
H: second length adjusting device
I: third length adjusting device
J: fourth length adjusting device
M: interval between a first length adjusting device and a second length adjusting device
M1: interval between a third length adjusting device and a fourth length adjusting device
N: an overlapping area of a first and a second elastic body, outside a interval between a first and a second length adjusting device
N2: an overlapping area of a third and a fourth elastic body, outside a interval between a third and a fourth length adjusting device
P: first elastic part
P1: additional elastic part
K: elastic body connector
L: ring
R: length adjusting device in a form of rings
S: length adjusting device in a form of a hook

What is claimed is:

1. A hip and leg exercise device comprising: a strap made of substantially elastic material, said strap having a proximal end and a distal end; a connector, with one end of the connector attached to the proximal end of the strap and the other end of the connector attached to an intermediate portion of the strap, forming a portion of the strap into a closed loop section having a constant diameter in a relaxed state with a remainder section extending away from the connector, wherein a diameter of the closed loop is less than six times a width of the strap, and the closed loop is adapted to wrap around both thighs of a user; an adjustment device configured to move along the length of the closed loop section and the remainder section, without changing the diameter of the closed loop section, such that the adjustment device fixes a portion of the remainder section to overlap with a portion of the closed loop section, such that the user can adjust a resistance of the exercise device by sliding the adjustment device along the length of the strap to increase or decrease the amount of overlap.

* * * * *